US005244551A

United States Patent [19]

Brücken et al.

[11] Patent Number: 5,244,551

[45] Date of Patent: Sep. 14, 1993

[54] PROCESS OF REGENERATING WASTE PICKLE WHICH CONTAINS METAL SALTS AND ACIDS

[75] Inventors: Volker Brücken; Albert Kaune, both of Königstein; Manfred Pötzschke, Kronberg; Ernst Wallis, Eschborn, all of Fed. Rep. of Germany

[73] Assignee: Metallgesellschaft Aktiengesellschaft, Frankfurt, Fed. Rep. of Germany

[21] Appl. No.: 958,529

[22] Filed: Oct. 8, 1992

Related U.S. Application Data

[63] Continuation of Ser. No. 722,563, Jun. 27, 1991, abandoned.

[30] Foreign Application Priority Data

Jun. 28, 1990 [DE] Fed. Rep. of Germany ..... 4020560

[51] Int. Cl.[5] ..... C25B 15/08; C25C 1/06

[52] U.S. Cl. ..... 204/151; 204/182.4; 204/149; 423/488

[58] Field of Search ..... 204/151, 182.4, 149; 423/488

[56] References Cited

U.S. PATENT DOCUMENTS 4,609,443 9/1986 Nogueira ..... 204/104

4,943,360 7/1990 Sugisawa et al. ..... 204/182.3

OTHER PUBLICATIONS

Acid Purification Unit (APU) Brochure.

Hatch et al., "Acid Retardation," I&EC Process design and development (1963) pp. 253-263.

Munns, "Iron removal from pickle liquors using absorption resin technology," pp. 537-548.

Y. Kobuchi et al., "Application of Ion Exchange Membranes to the Recovery of Acids by Diffusion Dialysis," (1986) pp. 173-179.

C. Horner et al., "Electrolytic Treatment of Waste Sulfate Pickle Liquor Using Anion Exchange Membranes," (1955) pp. 1121-1129.

*Primary Examiner*—John Niebling

*Assistant Examiner*—Arun S. Phasge

*Attorney, Agent, or Firm*—Sprung Horn Kramer & Woods

[57] ABSTRACT

A waste pickle which has been formed in the surface treatment of rolled stock consisting of steel and contains metal salts and acids and specifically contains nitric and hydrofluoric acids and nickel salts, chromium salts, and iron salts is subjected to an acid dialysis and a membrane electrolysis. To permit a recycling of free acids at a high rate and a recovering of the metals in a form in which they can directly be used in the melting process, the acid dialysis performed for a recovery of the free nitric acid and hydrofluoric acids is succeeded by a membrane electrolysis, in which the metals are recovered from the depleted effluent from the acid dialysis, which effluent has been depleted of free acid, and the enriched effluent from the acid dialysis, which enriched effluent has been enriched with free acids, and the effluent from the membrane electrolysis, which effluent has been depleted of metals, are subjected to an evaporation.

4 Claims, 1 Drawing Sheet

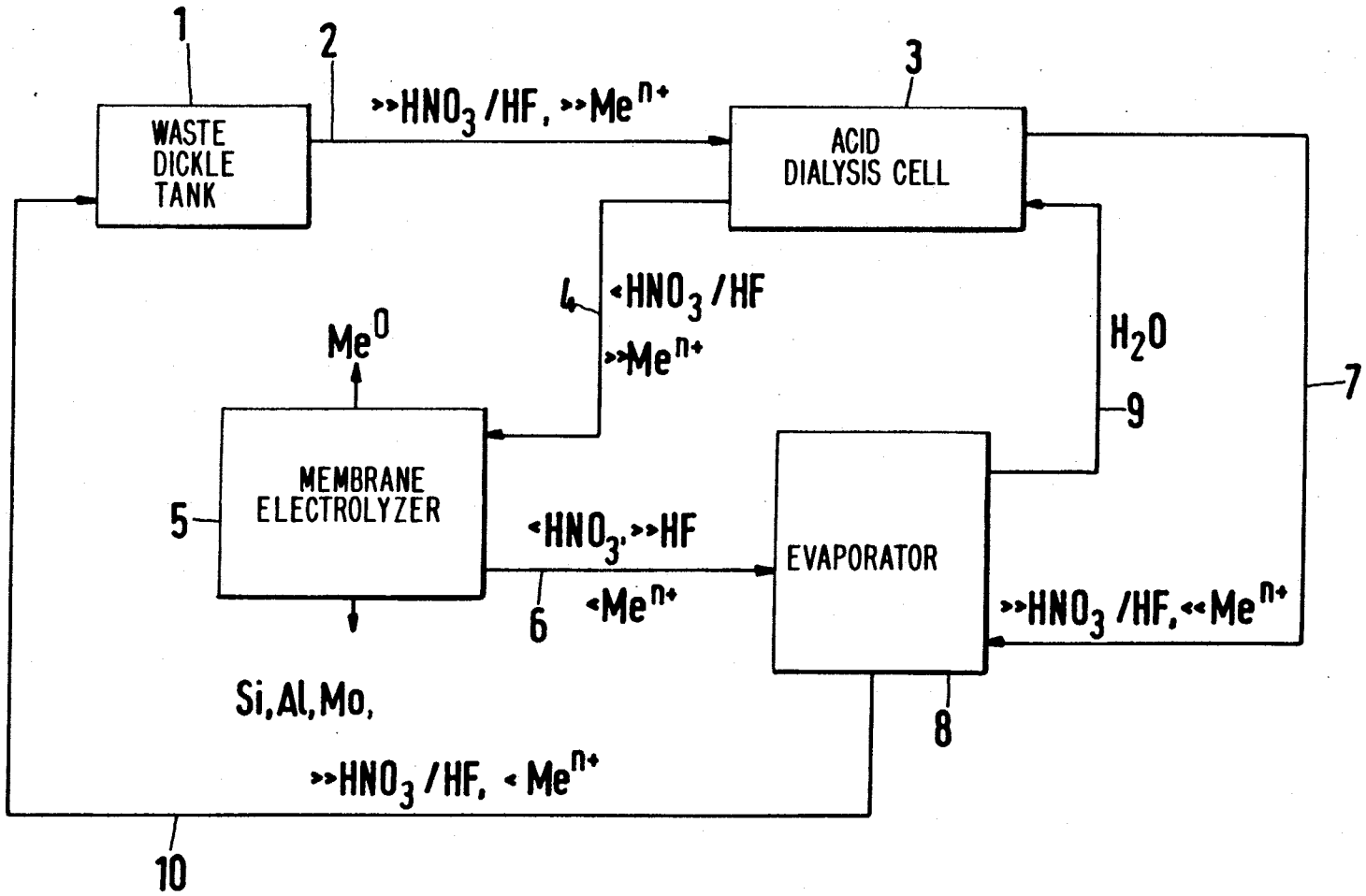
WASTE DICKLE TANK
ACID DIALYSIS CELL
MEMBRANE ELECTROLYZER
EVAPORATOR
>>HNO3/HF, >>Me^n+
<HNO3/HF
<HNO3, >>HF
<Me^n+
>>HNO3/HF, <Me^n+
H2O
Me^0
Si, Al, Mo,
>>HNO3/HF, <Me^n+
1
2
3
4
5
6
7
8
9
10

PROCESS OF REGENERATING WASTE PICKLE WHICH CONTAINS METAL SALTS AND ACIDS

This application is a continuation, of application Ser. No. 722,563, filed Jun. 27, 1992 now abandoned.

DESCRIPTION

This invention relates to a process of regenerating waste pickle which contains metal salts and acids and has been derived from an aqueous pickling solution in the surface treatment of rolled stock made of stainless and heat-resisting steels and is subjected to acid dialysis and membrane electrolysis.

Rolled stock made of stainless heat-resisting steels is usually subjected to a final heat treatment. The scale layers formed on the surface of the rolled stock as a result of such heat treatment are initially removed by sand blasting and this is succeeded by a chemical surface treatment by means of a mixture of nitric and hydrofluoric acids. In dependence on the quality of the steel and the duration of the pickling treatment, the resulting waste pickle may have a total metal content of up to and 80 g/l and more; that total metal content may substantially consist of the elements iron, chromium and nickel contained in the alloy.

It is known that a partial stream of such waste pickles may be passed initially over a sedimentation filter to effect a settling of the impurities contained in such waste pickle, and may subsequently be passed through a bed of resin, by which the acid is absorbed whereas the metal salts can flow from said filter. When the bed of resin has completely been loden with acid, the acid is removed by a rinsing with water and is recycled to the pickling bath. In that process, about 90% of the nitric and of the hydrofluoric acids are recycled. Owing to the relatively high percentage of metal which remains in solution, the regenerated acid must be expected to have a metal content of about 50%. Because the metals cannot be recovered, the concentration of the metals in the pickling solution is progressively increased. The filter cake formed in the sedimention filter is subjected to a waste water neutralization and is then dumped.

In another process the waste pickel is mixed with an organic solvent in an extractor so that the free acid is removed from the waste pickle. An addition of sulfuric acid in the extractor results in a liberation of the metal salts with formation of metal sulfate. The acids dissolved in the organic solvent are separated by a rinsing with water in a stripper. About 90% of the nitric acid and about 70% of the hydrofluoric acid are recycled in the regenerated pickle. The residual acid which is not extracted remains in the solution which contains metal sulfate. A disadvantage of that process resides in the use of an organic solvent and in the expensive waste disposal involved therein. Besides, the solution which contains metal sulfate must be filtered and washed in order to remove the nitric acid and hydrofluoric acid associated with the metal sulfate.

Alternatively, the waste pickle together with sulfuric acid in a concentration of 60 to 70% can be supplied to an evaporator while a heat exchanger maintains the acid in the evaporator at a temperature of 80° C. so that the nitric and hydrofluoric acids are distilled off and are subsequently condensed in a cooler. About 99% of the hydrofluoric acid and about 95% of the nitric acid are recycled in the regenerated pickle. The metal-containing sulfuric acid is treated so as to crystallize and subsequently separate iron and chromium as jarosite and chromium hydroxide in a weakly acid solution. The overflow of the separator is supplied to reactors, in which an alkalinization is effected and nickel is subsequently separated as a hydroxide. That process requires expensive equipment.

In the so-called evaporating process, the concentration of waste pickle is increased in an evaporator and the concentrate, which contains metal fluoride, is supplied to a crystallizer, which is succeeded by a filter. The filtrate and the condensate formed by the evaporated acid are recycled to the pickling bath. Up to 90% of the free acids are recycled. The neutralization of the moist filter residue with caustic lime results in a formation of an additive slag-forming material, which contains about 3% residual moisture and may be used in steelmaking. The metals do not constitute valuable materials and the additive slag-forming material can be used only to make tonnage steels.

Published Japanese Application 53 019 171 discloses the regeneration of waste pickles which contain metal ions and acid in a process in which the free acids are recovered by a dialysis and the metals are recovered by a succeeding membrane electrolysis of the waste pickle, which has been depleted of free acids. That process is mainly used to regenerate sulfuric acid-containing pickles for iron.

It is the object of the present invention to provide a process which is of the kind described first hereinbefore and in which waste pickles which contain nitric and hydrofluoric acids and metals and have been formed by a chemical surface treatment of rolled stock made of stainless and heat resisting steels can be regenerated in such a manner that

- a high proportion of the free acids is recycled,
- a low percentage of metal salts is contained in solution in the regenerated pickle,
- the metals nickel, chromium, and iron are recovered in a form in which they can directly be used in a melting process,
- a residual waste pickle is obtained, which need not be dumped, and
- energy and supplied are required only in small amounts.

That object is accomplished in that the waste pickle, which contains mainly nitric and hydrochloric acids and also contains nickel salts, chromium salts, and iron salts, is subjected to an acid dialysis for recovering the free nitric and hydrofluoric acids, the depleted effluent from the acid dialysis, which effluent is depleted of free acids, is subjected to a membrane electrolysis for a recovery of the metals, and the enriched effluent from the acid dialysis, which effluent is enriched with free acids, and the effluent from the membrane electrolysis, which effluent is depleted of metal, are subjected to evaporation.

By the acid dialysis, the free acids of the waste pickle are selectively removed from the waste pickle by means of ion exchange material membranes in that distilled water for absorbing the free acids and the waste pickle, which contains nitric and hydrofluoric acids and metal, are caused to flow in mutually opposite directions on opposite sides of the ion exchange material membranes. Owing to the difference between their concentrations in the two liquid streams, the nitric and hydrofluoric acids diffuse from the waste pickle into the absorbing water and the metal salts are retained with the exception of a relatively small amount which is diffused through the membrane.

In the electrolysis of metals, cation exchange material membranes are disposed between the cathodes and the anodes and nickel, chromium and iron are deposited in metallic form on the cathode. As a result, free hydrofluoric acid is re-formed and the nitric acid is partly reduced. The two streams are evaporated in the evaporator for an equalization of the water balance, the vapor is supplied to the acid dialyzer and the regenerated pickle is supplied to the pickling bath.

According to a special feature of the process in accordance with the invention the dialysis is performed at a volume flow rate of 0.5 to 10 liters/hour x $m^2$ of membrane surface area and the membrane electrolysis is performed with a cathode potential of −400 to −1000 $mV_h$, which corresponds to a cell voltage of 2.8 to 5.0 volts.

According to a special feature of the process in accordance with the invention the freely selectable potential at the cathode is held constant by means of a constant-potential rectifier and a reference electrode.

The process in accordance with the invention will be explained more in detail and by way of example with reference to a flow scheme shown in the drawing.

A waste pickle composed of

| | |
|---|---|
| $H^+$ | about 1.77 to 2.02 g/l |
| $HNO_3$ | about 80 g/l |
| HF | about 10 to 15 g/l |
| $\Sigma -F^-$ | about 35 to 50 g/l |
| Fe | about 33 g/l |
| Ni | about 5 g/l |
| Cr | about 6 g/l |

is supplied from tank 1 through line 2 to a dialysis cell 3 at a volume flow rate of 2 liters/hour x $m^2$ membrane surface area. Distilled water at the same velocity and at the same volume flow rate flows on the other side of the ion exchange material membrane in a counter-flow operation and absorbs about 65% of the nitric acid, about 95% of the hydrofluoric acid and 3.6% of the salts. The waste pickle which has been depleted of free acids is composed of

| | |
|---|---|
| $H^+$ | about 0.46 g/l |
| $HNO_3$ | about 30 g/l |
| HF | about 1 g/l |
| $\Sigma -F^-$ | about 20 g/l |
| Fe | about 31 g/l |
| Ni | about 5 g/l |
| Cr | about 4.6 g/l |

and is supplied via line 4 to the cathode compartment of the membrane electrolyzer 5. The electrolyte of the anode compartment contains 1% hydrofluoric acid. At a cell voltage amounts to 4 volts (cathode potential—600 $mV_h$) and a current of 200 amperes/$m^2$, a depletion of metal by about 90% is effected within 24 hours and free hydrofluoric acid is recovered because in addition to the deposition of metal a formation of free hydrofluoric acid is effected by a partial reaction at the anode. The effluent from the membrane electrolyzer 5 and the depleted effluent from the acid dialyzer 3 are supplied through lines 6 and 7 to an evaporating stage 8. The vapor formed by the evaporation is directly supplied through line 9 to the acid dialyzer 3. The liquid discharged from the evaporating stage consists substantially of nitric and hydrofluoric acids and small amounts of metal salt and is supplied through line 10 to a pickle tank 1. The elements silicon, aluminum, molybdenum, etc. are selectively recovered from the membrane electrolyzer 5 and the metals nickel, chromium, and iron are recovered. The pickle discharged from the electrolyzer was composed of

| | |
|---|---|
| $H^+$ | 1.42 g/l |
| $HNO_3$ | 22.4 g/l |
| HF | 22.0 g/l |
| $\Sigma -F^-$ | 22.0 g/l |
| Fe | 5.0 g/l |
| Ni | 0.38 g/l |
| Cr | 0.8 g/l |

From the results of the several process steps it is apparent that the pickle described hereinbefore had been almost entirely completely regenerated so that it could be recycled to the pickling bath. The metals can be deposited within certain current density ranges and hydrofluoric acid is formed in the electrolyzer at the same time.

We claim:

1. A process of regenerating waste pickle which contains metal salts and acids and has been derived from an aqueous pickling solution in the surface treatment of rolled stock made of stainless and heat-resisting steel, which comprises subjecting the waste pickle, which contains mainly nitric and hydrofluoric acids and also contains nickel salts, chromium salts, and iron salts, to an acid dialysis for recovering the free nitric and hydrofluoric acids and an effluent depleted of free acids, treating the depleted effluent from the acid dialysis in a membrane electrolysis cell for a recovery of the metals, said cell having anode and cathode compartments separated by a cation membrane, and subjecting the free nitric and hydrofluoric acids from the acid dialysis and an acid enriched, metal depleted effluent from the cathode compartment to evaporation, and recycling the evaporated free acids.

2. A process according to claim 1, characterized in that the acid dialysis is performed at a volume flow rate of 0.5 to 10 liters/hour$\times m^2$ of membrane surface area and the membrane electrolysis is performed with a freely selectable cathode potential of −400 to −1000 $mV_h$, which corresponds to a cell voltage of 2.8 to 5.0 volts.

3. A process according to claim 2, characterized in that in the membrane electrolysis the freely selectable potential at the cathode is held constant by means of a constant-potential rectifier and a reference electrode.

4. A process according to claim 1, characterized in that the waste pickle which has been depleted of free acids is used as a catholyte and a mixed solution of up to about 1% nitric and hydrofluoric acids is used as an anolyte.

* * * * *